US007626334B2

(12) United States Patent
Hur et al.

(10) Patent No.: US 7,626,334 B2
(45) Date of Patent: Dec. 1, 2009

(54) PLASMA DISPLAY PANEL

(75) Inventors: Min Hur, Suwon-si (KR); Jae-Yong Lim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 423 days.

(21) Appl. No.: 11/367,419

(22) Filed: Mar. 6, 2006

(65) Prior Publication Data

US 2006/0214584 A1 Sep. 28, 2006

(30) Foreign Application Priority Data

Mar. 24, 2005 (KR) ..... 10-2005-0024502

(51) Int. Cl.
*H01J 17/00* (2006.01)

(52) U.S. Cl. ..... 313/581; 345/37; 313/584

(58) Field of Classification Search ..... 313/582–587; 345/37, 41, 60, 71
See application file for complete search history.

(56) References Cited

U.S. PATENT DOCUMENTS

| | | | | |
|---|---|---|---|---|
| 5,744,909 | A * | 4/1998 | Amano | 313/585 |
| 6,169,363 | B1 | 1/2001 | Mori et al. | |
| 6,407,503 | B1 | 6/2002 | Mizobata | |
| 7,067,979 | B2 | 6/2006 | Sakamoto | |
| 7,116,047 | B2 | 10/2006 | Kim et al. | |
| 2003/0034734 | A1 * | 2/2003 | Kim et al. | 313/582 |
| 2003/0155863 | A1 * | 8/2003 | Lee | 313/587 |
| 2003/0193487 | A1 * | 10/2003 | Yatsuda et al. | 345/204 |
| 2004/0232843 | A1 * | 11/2004 | Kim et al. | 313/586 |

FOREIGN PATENT DOCUMENTS

| | | | |
|---|---|---|---|
| CN | 1 393 840 | A | 1/2003 |
| CN | 1 574 165 | A | 2/2005 |
| JP | 06-044907 | A | 2/1994 |
| JP | 09-035640 | A | 2/1997 |
| JP | 2000-090835 | A | 3/2000 |
| JP | 2000-133144 | A | 5/2000 |
| JP | 2000-323038 | A | 11/2000 |
| JP | 2003-151449 | A | 5/2003 |

(Continued)

*Primary Examiner*—Peter J Macchiarolo
*Assistant Examiner*—Donald L Raleigh
(74) *Attorney, Agent, or Firm*—Lee & Morse, P.C.

(57) ABSTRACT

A plasma display panel includes a first substrate and a second substrate that partially define a plurality of discharge cells in a space therebetween, and an electrode structure including an address electrode extending along a first direction, a dielectric layer formed on the address electrode, a first electrode extending along a second direction intersecting the first direction, and a second electrode extending along the second direction intersecting the first direction, where the first electrode and the second electrode are electrically insulated from the address electrode, and at least a portion of each of the first electrode and the second electrode is associated with each of the discharge cells. At least one of the address electrode and the dielectric layer associated with each of the discharge cells may include a first portion and a second portion. The first portion may have a first thickness along a third direction and the second portion may have a second thickness along the third direction, where the third direction intersects the first direction and the second direction. The first thickness may be different from the second thickness.

19 Claims, 11 Drawing Sheets

FOREIGN PATENT DOCUMENTS

| | | | | |
|---|---|---|---|---|
| JP | 2003-197106 | A | | 7/2003 |
| JP | 2003-208853 | A | | 7/2003 |
| JP | 2005-056723 | A | | 3/2005 |
| KR | 10-2001-0019211 | A | | 3/2001 |
| KR | 2002029491 | A | * | 4/2002 |

* cited by examiner

PLASMA DISPLAY PANEL

BACKGROUND OF THE INVENTION

1. Field of the Invention

The invention relates to a plasma display panel. More particularly, the invention relates to an electrode structure of a plasma display panel that may be employed to provide a more efficient plasma display panel.

2. Description of the Related Art

Plasma display panels (PDPs) are generally flat panel display devices that display images using gas discharge phenomena. PDPs utilize visible rays generated by gas discharge of the gas maintained in a vacuum in discharge cells. The gas discharge generates vacuum ultraviolet rays (VUVs) that collide with and excite phosphors in the respective discharge cells to emit light of a corresponding color. PDPs may be used to provide large screen display devices. In particular, PDPs may be used to provide large screen display devices with high resolution.

One type of PDP has a three-electrode surface discharge structure. The three-electrode surface discharge structure generally includes a front substrate including a plurality of, e.g., two, display electrodes, and a rear substrate spaced a predetermined distance apart from the front substrate and including an address electrode. A space between the front substrate and the rear substrate may be partitioned into a plurality of discharge cells by barrier ribs. Each discharge cell may be filled with a discharge gas and each discharge cell may include a phosphor of a predetermined color.

Gas discharge may occur when a voltage is applied to electrodes of the PDP. A discharge, e.g., an address discharge, may occur when an electric is field is formed between facing surfaces of a display electrode and an address electrode and/or a discharge, e.g., a sustain discharge, may occur when a voltage is applied to a display electrode. In such three-electrode surface discharge type PDPs, the address discharge generally occurs as a result of a voltage potential created between opposing portions of the respective address and display electrodes and the sustain discharge generally occurs as a result of a surface discharge of the display electrode(s). It is known that, in general, a higher voltage may be required to induce a sustain discharge when using one or more electrodes arranged on a single plane or surface than when using opposing portions of two or more electrodes to discharge the gas existing therebetween.

In general, to display a predetermined image on such three electrode surface discharge type PDPs, multiple discharge steps are generally performed. One or all of the multiple discharge steps may negatively impact the efficiency, i.e., ratio of luminance to power consumption, of such PDPs. In general, the efficiency of such PDPs is low.

The above information disclosed in this Background section is only provided to aid in the understanding of one or more aspects of the invention, and is not to be considered nor construed as constituting prior art.

SUMMARY OF THE INVENTION

The present invention is therefore directed to an improved electrode structure and a plasma display apparatus employing such an improved electrode structure, which substantially overcome one or more of the problems due to the limitations and disadvantages of the related art.

It is therefore a feature of embodiments of the invention to provide a plasma display panel that is capable of operating with lower discharge initiation voltage in relation to known PDPs.

It is therefore a feature of embodiments of the invention to provide a plasma display panel having improved efficiency by reducing energy loss in relation to known PDPs.

At least one of the above and other features and advantages of the present invention may be realized by providing a plasma display panel including a first substrate and a second substrate that may partially define a plurality of discharge cells in a space therebetween, an address electrode extending along a first direction, a dielectric layer formed on the address electrode, a first electrode extending along a second direction intersecting the first direction, and a second electrode extending along the second direction intersecting the first direction, where the first electrode and the second electrode may be electrically insulated from the address electrode, and at least a portion of each of the first electrode and the second electrode may be associated with each of the discharge cells. A phosphor layer may be formed with each of the discharge cells. At least one of the address electrode and the dielectric layer associated with each of the discharge cells may include a first portion and a second portion. At least a portion of the first portion may have a first thickness along a third direction and the second portion may have a second thickness along the third direction, where the third direction intersects the first direction and the second direction. The first thickness may be different from the second thickness.

The first portion may extend in a space between the first electrode and the second electrode associated with the one of the discharge cells. The second portion may connect respective first portions of adjacent ones of the discharge cells. The first electrode or the second electrode may be shared by discharge cells neighboring each other along the first direction such that a respective surface of the first electrode or the second electrode is exposed to each of the neighboring discharge cells with which the first electrode or the second electrode is associated. One of the first electrodes and one of the second electrodes may be arranged between discharge cells neighboring each other along the first direction.

The plasma display panel may include a plurality of each of the first electrodes and the second electrodes arranged parallel to each other.

A step may be formed at a boundary between the first portion and the second portion of one of the address electrode and the dielectric layer. The step may be formed along at least one of a surface of the dielectric layer and a surface of the first electrode that faces the second electrode. The step may be formed at the boundary between the first portion and the second portion of the dielectric layer. At the boundary between the first portion and the second portion of the dielectric layer, a thickness of the dielectric layer may gradually change from the first thickness to the second thickness, where the first thickness may be smaller than the second thickness. The first thickness and the second thickness of the address electrode may be equal. The first thickness of the first electrode may be greater than the second thickness of the address electrode. A width of first portion the first electrode along the first direction may be greater than a width of the second portion of the address electrode along the first direction.

The step may be formed at the boundary between the first portion and the second portion of the address electrode. The step may be formed at the boundary between the first portion and the second portion of the address electrode and the first portion may completely extend along the second direction between the first electrode and the second electrode associated with one of the discharge cells. The first portion of the address electrode may include at least one protrusion extending only a portion of a distance along the second direction between the first electrode and the second electrode associated with one of the discharge cells, where the at least one protrusion may have the first thickness. The first thickness of the address electrode may be greater than the second thickness of the address electrode.

The plasma display panel may further include a second dielectric layer covering the first electrode and the second electrode. The second dielectric layer may continuously surround neighboring ones of the first and second electrodes extending between neighboring ones of the discharge cells. The second dielectric layer may surround each of the first electrodes and the second electrodes extending between neighboring ones of the discharge cells such that a gap exists between the first and second electrodes. One of the first electrodes and one of the second electrodes may extend between each of the neighboring ones of the discharge cells.

At least one of the above and other features and advantages of the present invention may be separately realized by providing a plasma display panel including a first substrate, a second substrate disposed facing the first substrate with a space including a plurality of discharge cells therebetween, a first electrode extending along a first direction in the space between the first substrate and the second substrate, second and third electrodes extending along a second direction crossing the first direction in the space between the first substrate and the second substrate, the second and third electrodes may extend between neighboring ones of the discharge cells, and a dielectric layer may be formed on the first electrode. The second and third electrodes may be electrically isolated from the first electrode, and the first electrode and the dielectric layer may have a structure providing a higher capacitance within each discharge cell than between neighboring discharge cells.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF EXEMPLARY EMBODIMENTS

Figure 1:
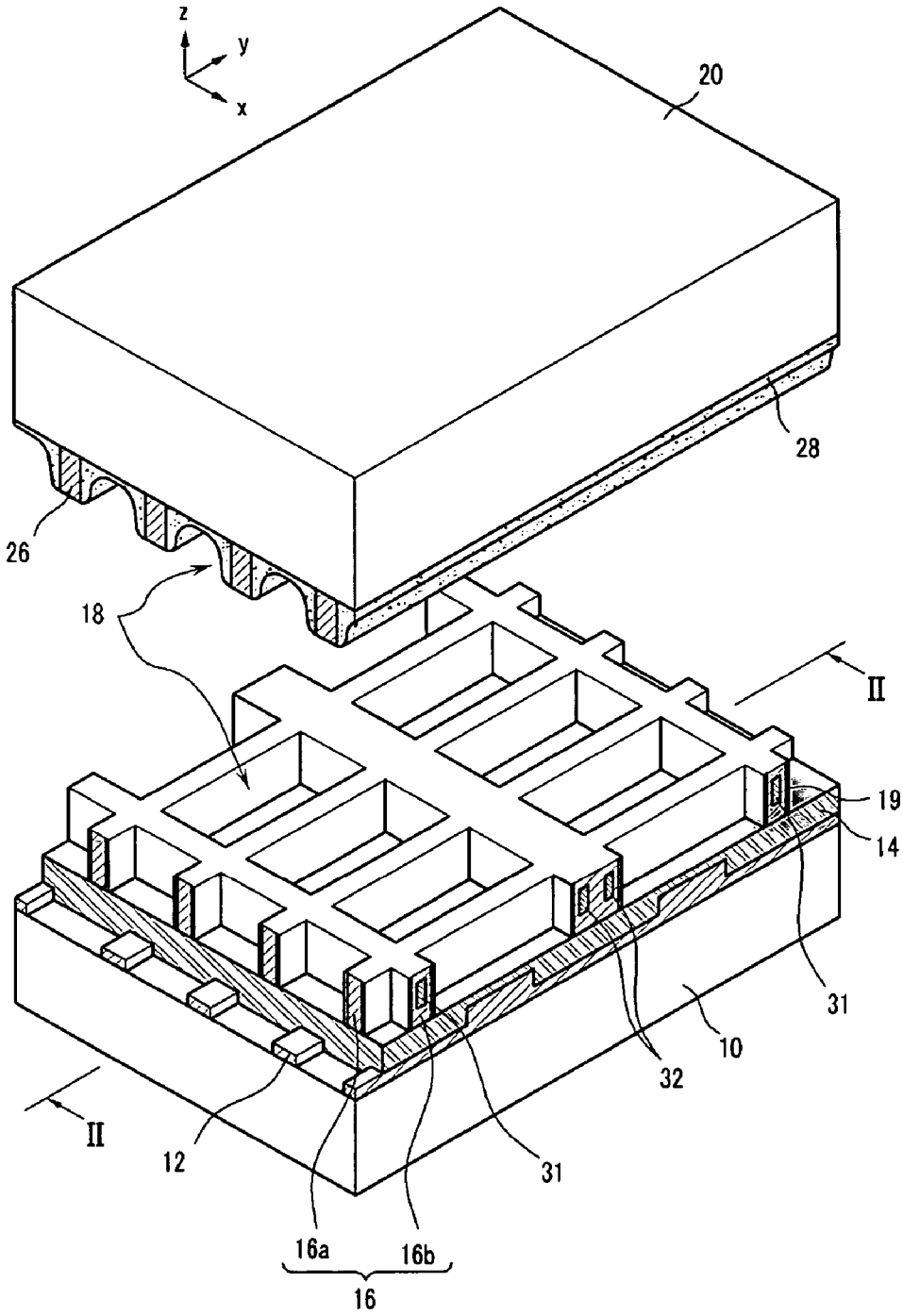
FIG. 1 illustrates a partial exploded perspective view of a plasma display panel according to a first exemplary embodiment of the invention.

Korean Patent Application No. 10-2005-0024502 filed in the Korean Intellectual Property Office on Mar. 24, 2005, and entitled: "Plasma Display Panel," is hereby incorporated by reference in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
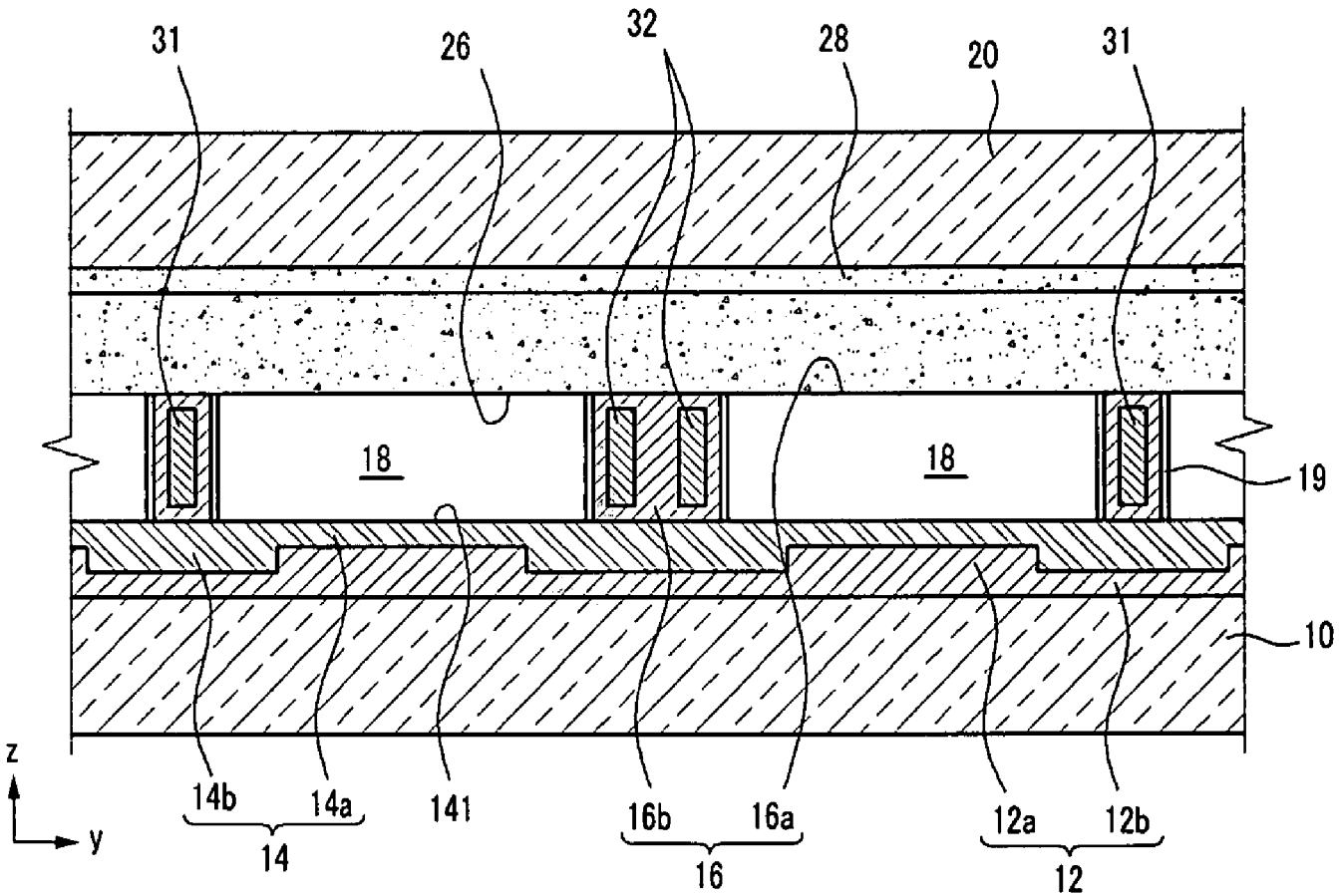
FIG. 2 illustrates a partial sectional view of the plasma display panel along line II-II of FIG. 1.
Figure 3:
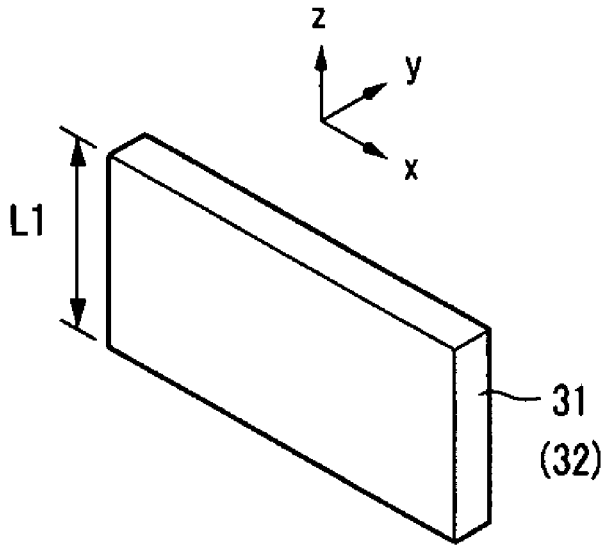
FIG. 3 illustrates a schematic of a partial perspective view of an exemplary embodiment of first electrodes and/or second electrodes employable by embodiments of the invention.

FIG. 1 illustrates a partial exploded perspective view illustrating a plasma display panel according to a first exemplary embodiment of the invention. FIG. 2 illustrates a partial sectional view of the plasma display panel along line II-II of FIG. 1. FIG. 3 illustrates a schematic partial perspective view illustrating an exemplary embodiment of first electrodes and/or second electrodes employable by embodiments of the invention.

As shown in FIGS. 1-3, the plasma display panel may include a first substrate, e.g., a rear substrate 10, a second substrate, e.g., front substrate 20, and barrier ribs 26. The front substrate 20 may be arranged to face the rear substrate 10 at a predetermined space away from the rear substrate 10. The barrier ribs 26 may partition a plurality of discharge cells 18 in the space between the rear substrate 10 and the front substrate 20. One or more phosphor layers 28 may be provided in each discharge cell 18. At least portions of a plurality of electrodes, e.g., address electrodes 12, sustain electrodes 31, and scan electrodes 32 may correspond to each of the discharge cell. The address electrodes 12, the sustain electrodes 31 and/or the scan electrodes may work together to generate VUV rays for forming a predetermined image on the plasma display panel when they collide against the phosphor layer(s) 28 of the discharge cells 18.

The barrier ribs 26 may at least partially partition the plurality of discharge cells 18 formed in the space between the rear substrate 10 and the front substrate 20. The barrier ribs 26 may be arranged on the front substrate 20. The barrier ribs 26 may be arranged parallel to each other. The barrier ribs 26 may extend along a first direction, e.g., Y-axis direction in FIG. 2. Each discharge cell 18 may have a substantially box-like shape.

As shown in the exemplary embodiment illustrated in FIGS. 1-3, the barrier ribs 26 may be arranged in a striped pattern with the barrier ribs 26 extending parallel to each other along one direction. The barrier ribs 26 are not limited to such a structure or arrangement and may have different shapes and/or may be arranged differently. For example, the barrier ribs 26 may have an arrangement in which barrier ribs intersect each other.

In embodiments of the invention, a second dielectric layer 16 may be arranged on the rear substrate 10. The second dielectric layer 16, as described below, may function to partition the discharge cells 18 from each other. In such embodiments, for example, barrier ribs 26 may not be provided.

Discharge gas, e.g., a mixture of xenon (Xe) and neon (Ne) may fill the discharge cells 18. The discharge gas may generate VUV rays using plasma discharge phenomena, as discussed above. The phosphor layers 28 may include green, red, and blue phosphor layers. Each of the discharge cells 18 may include one of the different colored phosphor layers 28. The phosphor layers 28, irrespective of their color, may absorb the VUV rays generated by plasma discharge and emit visible rays corresponding to the color of the respective phosphor layer 28. The phosphor layers 28 may be formed on one or more side surfaces of the barrier ribs 26 and/or a bottom surface of the front substrate 20. The phosphor layers 28 may be arranged directly on the front substrate 20. One or more intervening layers may exist between the phosphor layers 28 and the front substrate 20. The phosphor layers 28 may be formed on the rear substrate 10. The phosphor layers 28 may be formed on both the front substrate 20 and the rear substrate 10.

As shown in FIGS. 1 and 2, address electrodes 12 may be formed on a surface of the rear substrate 10 facing the front substrate 20. The address electrodes 12 may extend along the first direction. A predetermined space may exist between respective neighboring ones of the address electrodes 12. A more detailed description of an exemplary embodiment of the address electrodes 12 will be described below with reference to FIGS. 4 and 5. The features associated with reference numerals 12*a*, 12*b*, 14*a*, 14*b*, 16*a* and 16*b*, which are shown in FIGS. 1 and 2, will be described in detail below.

As shown in FIGS. 1 and 2, a first dielectric layer 14 may be formed over a surface of the rear substrate 10 facing the front substrate 20. The first dielectric layer 14 may completely cover the surface of the rear substrate 10 facing the front substrate 10. The first dielectric layer 14 may cover the address electrodes 12. The first dielectric layer 14 may include a surface 141 that faces the front substrate 20 and being substantially parallel to the rear substrate 10 and the front substrate 20. The first dielectric layer 14 is not, however, limited to such a structure.

Figure 4:
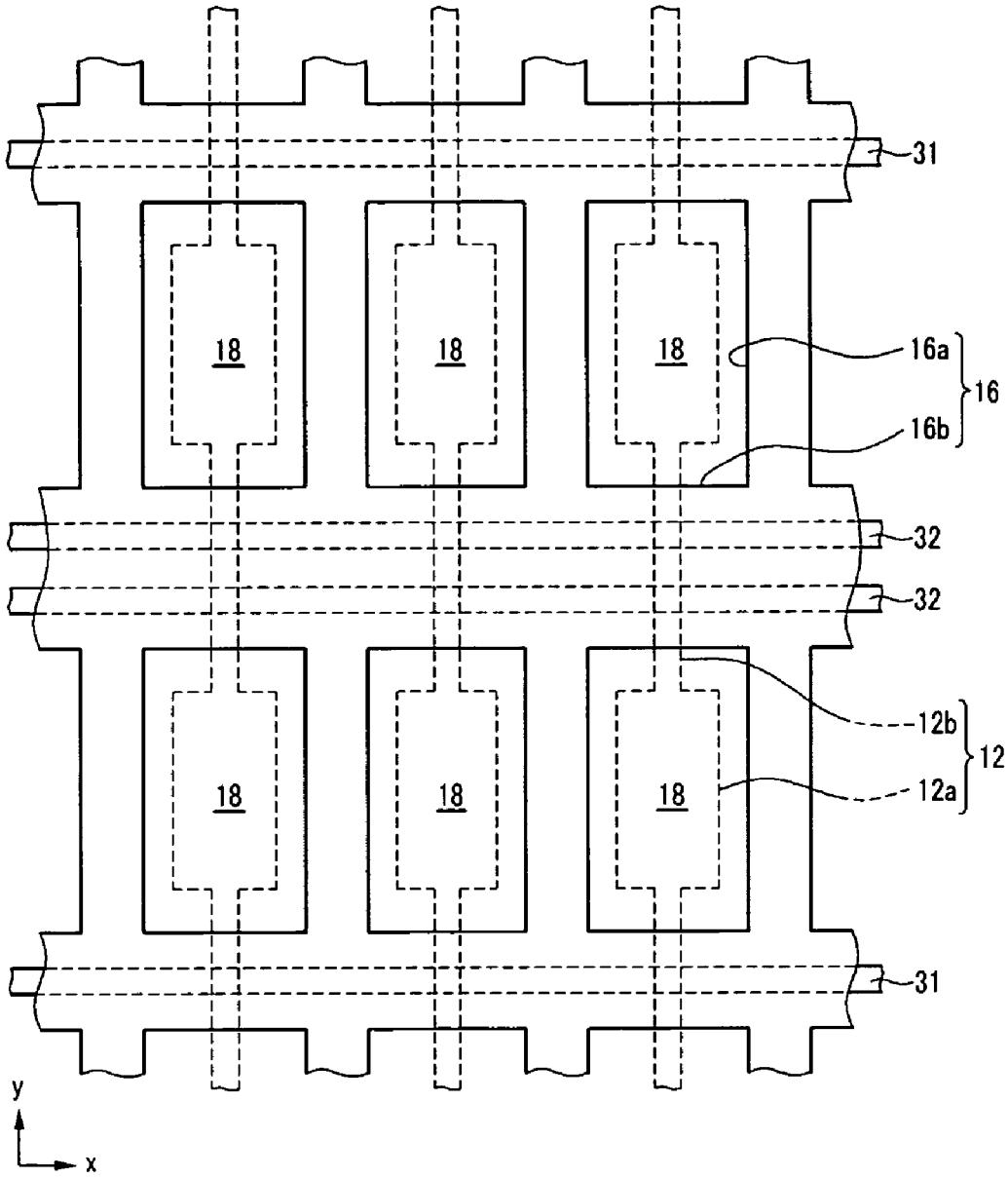
FIG. 4 illustrates a partial top plan view of the plasma display panel illustrated in FIG. 1.

As shown in FIGS. 1, 2 and 4, the plasma display panel may include first electrodes, e.g., sustain electrodes 31, and second electrodes, e.g., scan electrodes 32. The sustain electrodes 31 and the scan electrodes 32 may be formed over the first dielectric layer 14. The sustain electrodes 31 and the scan electrodes 32 may extend parallel to each other. The sustain electrodes 31 and the scan electrodes 32 may extend along a second direction, e.g., X-axis direction shown in FIG. 3, that crosses the first direction. The sustain electrodes 31 and the scan electrodes 32 may be electrically insulated from the address electrodes 12. For example, as shown in FIGS. 1 and 2, the sustain electrodes 31 may be electrically insulated from the scan electrodes 32 by the first dielectric layer 14.

As shown in FIGS. 1 and 2, each of the discharge cells may be associated with separate respective portions of the scan electrodes 32, and respective portions of the sustain electrode 31 may be shared by the discharge cells 18 neighboring each other along the first direction. A scan electrode/sustain electrode/scan electrode may be sequentially arranged in between a pair of the discharge cells 18 neighboring each other along the first direction. In embodiments of the invention, the sustain electrodes 31 and the scan electrodes 32 can be arranged differently as the invention is not limited to the arrangement shown in FIGS. 1, 2 and 4.

For a discharge during an addressing period, e.g., an address discharge, the scan electrodes 32 may be employed together with the address electrodes 12 to select one or more of the discharge cells 18 to be turned on. For a discharge during a sustain period, e.g., a sustain discharge, the sustain electrodes 31 may be employed together with the scan electrodes 32 to display a predetermined luminance. In embodiments of the invention, the electrodes may perform different functions depending on a signal voltage applied thereto.

As shown in FIG. 2, the sustain electrodes 31 and the scan electrodes 32 may be respectively formed along sides of the discharge cells 18. The sustain electrodes 31 and the scan electrodes 32 may arranged within a space between neighboring ones of the discharge cells 18. At least a portion of a respective one of the sustain electrodes 31 and at least a portion of a respective one of the scan electrodes 32 associated with one of the discharge cells 18 may be arranged to face other. A sustain discharge between the respective portions the sustain electrodes 31 and the scan electrodes 32 can result in a charge between respective facing portions thereof, thereby reducing a discharge initiation voltage.

As illustrated in FIGS. 1 and 2, the sustain electrode 31 and the scan electrode 32 may be respectively formed on the rear substrate 10 at facing sides of each discharge cell 18. The scan electrodes 32 and the sustain electrodes 31 may be made, for example, of a metal and/or a transparent conductive material. In embodiments where the sustain electrodes 31 and the scan electrodes 32 are formed, for example, outside of a boundary of respective discharge cells 18, the scan electrodes 32 and the sustain electrodes 31 may be made, for example, of a highly conductive metal without concern of the metal blocking visible light. In comparison to known conventional plasma display panels with electrodes that include a transparent electrode and a metal electrode, embodiments of the invention may be manufactured more simply by only providing metal electrodes. In comparison to known methods for forming plasma display panels, embodiments of the invention may provide simpler and less costly methods for manufacturing plasma display panels by employing single layer electrodes. Aspects of the invention separately provide plasma display panels with improved transmittance at least because, in embodiments of the invention, electrodes may not be formed at places between the front substrate and the rear substrate corresponding to discharge cells.

The phosphor layers 28 may be formed on the front substrate 20, and the address electrodes 12, the sustain electrodes 31 and the scan electrodes 32 may be formed on the rear substrate 10. By providing the address electrodes 12, the sustain electrodes 31 and the scan electrodes 32 on the rear substrate 10, problems due to differences in dielectric constants of different colored ones of the phosphor layers 28 can be reduced and/or prevented. In embodiments of the invention, the electrodes, e.g., the address electrodes 12 and the scan electrodes 32, which may be involved in the address discharge may be formed on a same substrate, e.g., the rear substrate 10. Thus, a loss or reduction in the address discharge can be reduced and/or prevented, thereby reducing the discharge initiation voltage.

As shown in FIG. 2, a second dielectric layer 16 may be formed to respectively surround the sustain electrode 31 and the scan electrode 32. The second dielectric layer 16 may include a dielectric layer portion 16*a* formed along the first direction, and a dielectric layer portion 16*b* formed along the second direction. The dielectric layer portion 16*b* may have the respective sustain electrode 31 and/or the respective scan electrode 32 disposed therein. In embodiments of the invention, the second dielectric layer 16 may accumulate wall charges formed by discharge and/or may at least partially partition a discharge space corresponding to the shape or boundary of each discharge cell 18.

The dielectric layer portion 16*b* that may have the sustain electrode 31 and/or the scan electrode 32 disposed therein may be formed to separately surround each of the scan electrodes 32 so as to form a void space between the scan electrodes 32 arranged between neighboring/adjacent ones of the discharge cells 18. As discussed above, respective portions of each of the scan electrodes 32 arranged between adjacent ones of the discharge cells 18 may be associated with one of the adjacent discharge cells. As shown in FIG. 2, in embodiments of the invention, the dielectric layer portion 16*b* may continuously surround the scan electrodes 32 arranged between adjacent ones of discharge cells 18.

The second dielectric layer 16 may be formed of a transparent material. Portions, e.g., front substrate side portions, of the second dielectric layer 16 may be formed of a colored material, e.g., dark colored material. In embodiments of the invention, all or some portions of the second dielectric layer 16 may formed of a black colored material, thereby Improving contrast of the display.

The sustain electrodes 31, the scan electrodes 32 and the second dielectric layer 16 surrounding the respective sustain electrodes 31 and/or the respective scan electrodes 32 may be fabricated using a thick film ceramic sheet (TFCS) method. Portions including portions of the sustain electrode 31, the scan electrode 32, and the second dielectric layer 16 may be separately fabricated and then combined to the rear substrate 10, which may include the address electrode 12 and the first dielectric layer 14.

FIG. 3 illustrates an exemplary structure for electrodes, e.g., the scan electrodes 32 and/or the sustain electrodes 31. The plurality of electrodes, e.g., the scan electrodes 32 and/or the sustain electrodes 31 may be arranged so as to form a striped-arrangement. As shown in FIG. 3, the sustain electrodes 31 and the scan electrodes 32 may have a solid rectangular-like shape. In embodiments of the invention in which the scan electrodes 32 and/or the sustain electrodes 31 have such rectangular plate-like or rectangular box-like shape, the scan electrodes 32 and the sustain electrodes 31 may be arranged such that each of the discharge cells 18 is associated with at least one of the scan electrodes 32 and at least one of the sustain electrodes 31. The scan electrodes 32 and/or the sustain electrodes 31 associated with adjacent ones of the discharge cells 18 may be arranged to form substantially parallel linear members that at least partially define the plurality of discharge cells 18 and extend along the second direction. For example, a length (L1) of each of the sustain electrodes 31 and/or the scan electrodes 32, which is measured along a third direction, e.g., Z-axis direction shown in FIG. 3, to a surface of the rear substrate may be substantially uniform along the second direction. In such embodiments, when portions of the sustain electrode 31, the scan electrode 32, and the second dielectric layer 16 are arranged on the rear substrate 10, end portions of the respective ones of the sustain electrodes 31 arranged along the second direction may contact each other. In embodiments of the invention, the sustain electrodes 31 and the scan electrodes 32 may selectively have a structure partitioned to correspond to the discharge space of each discharge cell.

As shown in FIG. 2, a protective film 19 may be formed on a surface of the second dielectric layer 16. The protective film 19 may be formed on the surface of the second dielectric layer 16 that is exposed to the plasma discharge (e.g., a surface of the second dielectric layer 16 forming a lateral side of the discharge cell 18). The protective film 19 may protect the second dielectric layer 16 from collision of ions ionized by the plasma discharge. The protective film 19 may be formed of a material having a high secondary electron emission coefficient that may emit secondary electrons to help improve the discharge efficiency.

The protective film 19 may be formed at lateral side(s) of the discharge cell 18, and may be formed of a material that does not transmit visible rays. In embodiments of the invention, the protective film 19 may be formed of a magnesium oxide (MgO) material that does not transmit visible rays. Such a non-transmissive MgO generally has a relatively higher secondary electron emission coefficient than a transmissive MgO, and therefore can improve the efficiency of discharge.

As shown in FIGS. 1 and 2, the protective film 19 may be formed only on the surface of the second dielectric layer 16. The invention is not, however, limited to such a structure. For example, in embodiments of the invention, the protective film 19 can be formed over a whole surface of the rear substrate 10 to cover the first dielectric layer 14 and the second dielectric layer 16.

Exemplary embodiments of the address electrodes 12 that may be employed in embodiments of the invention will be described in detail with reference to FIGS. 1 to 3 and FIGS. 4 and 5 below.

Figure 5:
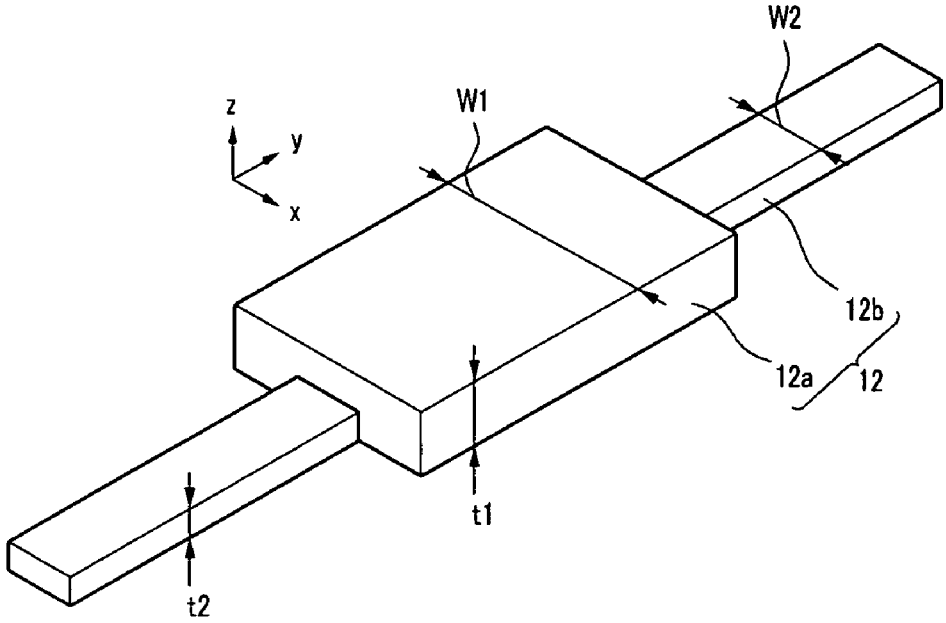
FIG. 5 illustrates a schematic of a partial perspective view of an exemplary embodiment of address electrodes employable by embodiments of the invention.

FIG. 4 illustrates a partial top plan view of the plasma display panel illustrated in FIG. 1. FIG. 5 is a schematic partial perspective view illustrating an exemplary embodiment of the address electrodes 12.

As shown in FIG. 4, the address electrode 12, or portion thereof, respectively associated with each of the discharge cells 18 may include a first portion 12*a* and a second portion 12*b*. The first portion 12*a* may be formed to correspond to the space between the respective sustain electrode 31 and the respective scan electrode 32. The second portion 12*b* may extend along the first direction and may electrically connect the first portions 12*a* with each other along the first direction.

The first portions 12*a* may respectively correspond to a central portion of the discharge cells 18 and may contribute a relatively larger amount to the address discharge than the second portions 12*b*. The second portions 12*b* may respectively correspond to an edge portion of the discharge cells 18 and/or may correspond to a connecting portion that connects adjacent ones of the first portions 12*a* associated with adjacent discharge cells 18. The second portions 12*b* may extend below the sustain electrode 31 and/or the scan electrode 32. The second portions 12*b* may contribute a relatively smaller amount to the address discharge than the first portions 12*a*.

The first portion 12*a* and the second portion 12*b* of the address electrode 12 may be formed to have different dimensions (e.g., different widths and/or thicknesses). In embodiments of the invention, the first portion 12*a* and the second portion 12*b* may have different dimensions such that a first portion of the first dielectric layer 14*a* covering the first portion 12*a* and a second portion of the first dielectric layer 14*b* covering the second portion 12*b* have different capacitances.

In general, the greater the area of corresponding electrodes and the thinner a dielectric layer between the corresponding electrodes, the greater the capacitance of the dielectric layer. When the capacitance of the dielectric layer, e.g., first dielectric layer portion 14*a*, between portions of the corresponding electrodes, e.g., the address electrode 12 and the scan electrode 32, making a larger contribution to the discharge is increased, a greater charge may be stored in the discharge space of that portion, thereby facilitating the discharge. Whereas, when the capacitance of the dielectric layer is increased at a portion making a smaller contribution to the discharge, the energy loss is increased, thereby deteriorating efficiency of an energy recovery circuit (ERC). In embodiments of the invention, dimensions, e.g., width, thickness, height, etc., of the address electrodes 12 may be controlled in view of these general principles.

As shown in FIG. 5, in embodiments of the invention, a width (w1) of the first portion 12*a* measured along the second direction may be larger than a width (w2) of the second portion 12*b* measured along the second direction.

As shown in FIG. 5, a thickness (t1) of the first portion 12*a* measured along the third direction may be larger than a thickness (t2) of the second portion 12*b* along the third direction. In embodiments of the invention, when the address electrodes 12 are arranged on the rear substrate 10, a surface of the respective first portion 12*a* facing the respective discharge cell 18 may be closer to the front substrate 20 than a surface of the respective second portion 12*b* facing the respective discharge cell. The invention is not, however, limited to such an embodiment.

For example, in embodiments of the invention having an electrode with a first portion and a second portion, the first portion may only have a larger thickness or only a larger width than the second portion. In embodiments of the invention, for example, the first portion may have both a larger thickness and a larger width than the second portion, and the first portion may only extend across a portion of a discharge cell along a direction substantially parallel to a direction along which a substrate (e.g., rear substrate 10) extends.

As shown in FIG. 2, the first portion 12*a* may be formed to have a greater thickness along the third direction than the second portion 12*b*. Thus, the first portion 12*a* may have a portion that protrudes outward, along the third direction, from the second portion 12*b* when the address electrode 12 is arranged on the rear substrate 10. The first portion 12*a* may have a side that extends outward from the first portion 12*b* and substantially parallel to a side of the scan electrode 32. The width of the first portion 12*a* may be formed larger that of the second portion 12*b* to increase areas of the address electrode exposed to the discharge cell 18 and capable of interacting with the scan electrode 32.

As shown in FIG. 2, a surface 141 of the first dielectric layer 14 facing the front substrate 20 may be formed to be substantially parallel to the first direction along which the rear substrate 10 and front substrate 20 extend. A thickness of the first portion of the first dielectric layer 14*a* covering the first portion 12*a* may be smaller than a thickness of the second portion of the first dielectric layer 14*b*.

Due to the smaller thickness of the first portion of the dielectric layer 14*a*, the first portion of the first dielectric layer 14*a* may have a larger capacitance. Due to the larger electrode area of the first portion of the dielectric layer 14*a*, the first portion of the first dielectric layer 14*a* may have a larger capacitance than the second portion of the first dielectric layer 14*b*. The first portion of the first dielectric layer 14*a* may cover the first portion 12*a*, may substantially correspond to the portion of the address electrode 12 making a greater contribution to the address discharge and may reduce the discharge initiation voltage of the address discharge.

As discussed above, in embodiments of the invention, the second portion 12*b* may be formed to have a smaller thickness and/or a smaller width than the first portion 12*a*. In such embodiments, the second portion 12*b* may have a smaller electrode area. In embodiments where the second portion 12*b* has a smaller thickness, a thickness of the second portion of the first dielectric layer 14*b* may be greater than a thickness of the first portion of the first dielectric layer 14*a* in order to provide the substantially parallel surface 141. As discussed above, the greater thickness of the second portion of the first dielectric layer 14*b* may reduce a capacitance between the respective second portion 12*b* and the corresponding scan electrode 32. The vicinity of the second portion of the first dielectric layer 14*b* may have a smaller capacitance and may make a smaller contribution to the address discharge. Thus, an energy loss that may occur during address discharge can be minimized. In plasma display apparatus employing one or more aspects of the invention, efficiency of an energy recovery circuit can be improved.

In embodiments of the invention, the first portion of the first dielectric layer 14*a* may cover the first portion 12*a* and a combination of the first portion 12*a* and the first portion of the first dielectric layer 14*a* may make a greater contribution to the address discharge than a combination of the second portion of the first dielectric layer 4*b* covering the second portion 12*b*. By selectively forming electrodes, e.g., address electrodes, of the plasma display panel with a plurality of portions have predetermined dimensions, e.g., thickness, width, electrical characteristics, e.g., capacitance, and/or functions, e.g., amount of contribution to discharge, the discharge initiation voltage may be reduced and the efficiency of the energy recovery circuit may be increased.

Other exemplary embodiments or variations of one or more aspects of the invention will be described below. To avoid repetition, only features of the exemplary embodiments or variations described below that are different from the features of the exemplary embodiment described above will be described.

Figure 6:
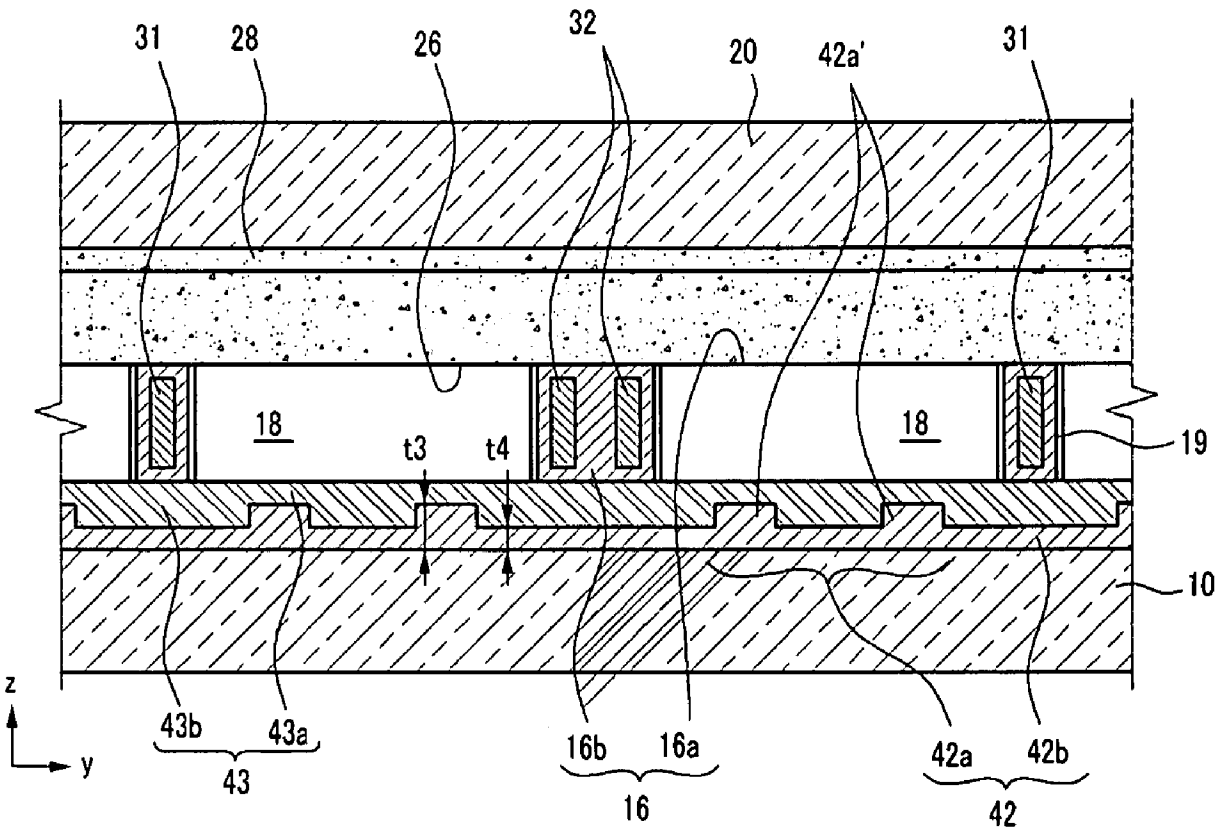
FIG. 6 illustrates a partial sectional view of a plasma display panel according to a second exemplary embodiment of the present invention.

FIG. 6 illustrates a partial sectional view of a second exemplary embodiment of a plasma display panel employing one or more aspects of the invention. As shown in FIG. 6, an address electrode 42 may include a first portion 42*a* and a second portion 42*b*. The first portion 42*a* may substantially correspond to a space between facing and corresponding ones of the sustain electrodes 31 and scan electrodes 32 associated with one of the discharge cells 18. The second portion 42*b* may electrically connect adjacent ones of the first portions 42*a* along a direction, e.g., the first direction. A width of at least a part of the first portion 42*a* may be relatively larger than a width of the second portion 42*b*. A thickness of at least a part of the first portion 42*a* may be greater than a thickness of the second portion 42*b*.

As shown in FIG. 6, the first portion 42*a* may include a plurality of protrusions 42*a*'. For example, two protrusions 42*a*' may be formed and more particularly, for example, one of the protrusions 42*a*' may be formed at each side of the first portion 42*a* neighboring the second portion 42*b*. In embodiments of the invention, as shown in FIG. 6, a thickness (t3) of the protrusion(s) 42*a*' of the first portion 42*a* may be larger than a thickness (t4) of the second portion 42*b*. A capacitance resulting from the corresponding protrusion portion 42*a*' and a first portion of the first dielectric layer 43*a* of a first dielectric layer 43 covering the first portion 42*a* may be larger than a capacitance resulting from the second portion 42*b* and a corresponding portion of a second portion of the first dielectric layer 43*b* of the first dielectric layer 43 covering the second portion 42*b*. A discharge initiation voltage can be reduced and efficiency of an energy recovery circuit can be improved by providing enabling a higher capacitance between the first portion 42*a* and a corresponding electrode of for causing a discharge in the respective discharge cell 18.

Figure 7:
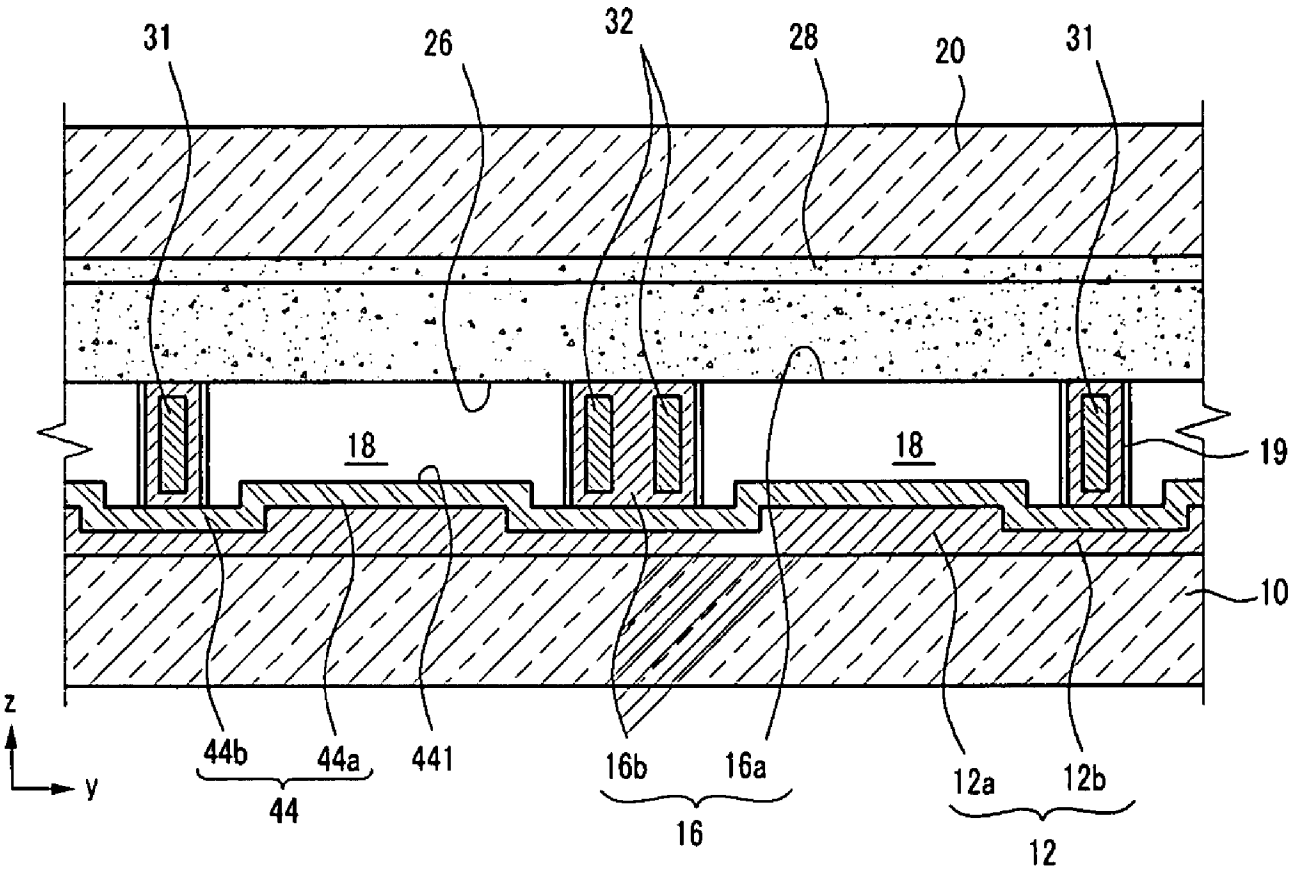
FIG. 7 illustrates a partial sectional view of a plasma display panel according to a third exemplary embodiment of the invention.

FIG. 7 illustrates a partial sectional view of a third exemplary embodiment of a plasma display panel employing one or more aspects of the invention. As shown in FIG. 7, a surface 441 of a first dielectric layer 44 facing the front substrate 20 may be formed to correspond to a shape of the address electrode 12. A first portion of the first dielectric layer 44*a* may cover a protrusion of the first portion 12*a* may extend along a plane that is closer to the front substrate 20 than a plane along which at least a part of a second portion of the first dielectric layer 44*b* covering the second portion 12*b* extends. The first dielectric layer 44 may be formed in various shapes.

Figure 8:
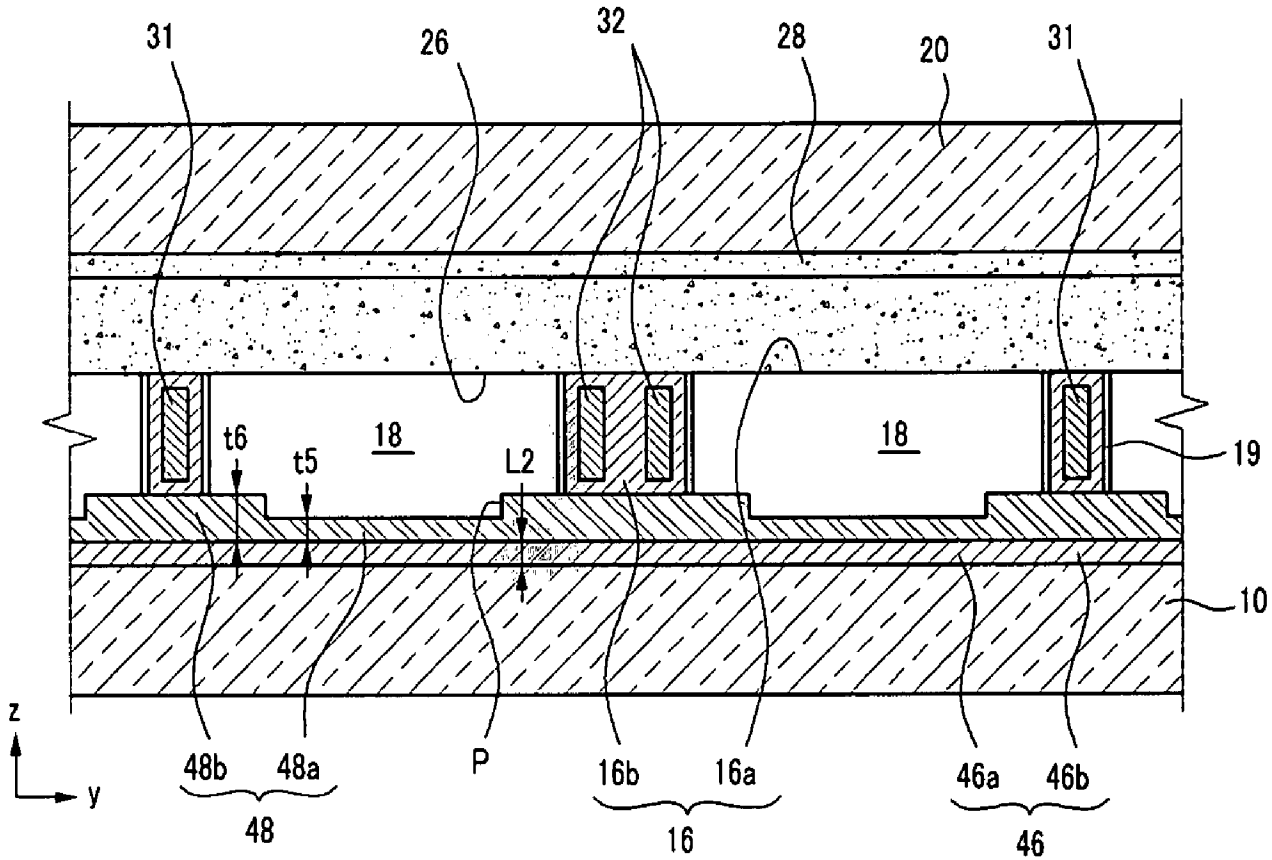
FIG. 8 illustrates a partial sectional view of a plasma display panel according to a fourth exemplary embodiment of the invention.

FIG. 8 illustrates a partial sectional view of a fourth exemplary embodiment of a plasma display panel employing one or more aspects of the invention. An address electrode 46 may include a first portion 46*a* and a second portion 46*b*. The first portion 46*a* may substantially correspond to a space between facing and corresponding ones of the sustain electrodes 31 and scan electrodes 32 associated with one of the discharge cells 18. The first portion 46*a* may have a relatively larger width than the second portion 46*b*. The second portion 46*b* may electrically connect adjacent ones of the first portions 46*a* along a direction, e.g., the first direction. A thickness (L2) of the first portion 46*a* of the address electrode 46 may be substantially the same as a thickness of the second portion 46*b* of the address electrode 46.

A first dielectric layer 48 may cover the address electrode (s) 46. A thickness (t5) of a first portion of a first dielectric layer 48*a* covering the first portion 46*a* may be different from a thickness (t6) of a second portion of the first dielectric layer 48*b* covering the second portion 46*b*. For example, the thickness (t5) of the first portion of the first dielectric layer 48*a* may be less than the thickness (t6) of the second portion of the first dielectric layer 48*b*. For example, the first portion of the first dielectric layer 48*a* may be formed as a depression such that the thickness (t5) of the first portion of the first dielectric layer 48*a* is less than the thickness (t6) of the second portion of the first dielectric layer 48*b*. A step (P) may be formed at a boundary between the first portion of the dielectric layer 48*a* and the second portion of the first dielectric layer 48*b*.

In embodiments of the invention, the first portion of the first dielectric layer 48*a* may correspond to a portion making a greater contribution to a discharge, e.g., address discharge, and/or may be formed with a smaller thickness to help increase a capacitance between the first portion 48*a* and the corresponding electrode, e.g., the scan electrode 32, of the discharge cell 18. By allowing a large voltage to be stored at the portion making the greater contribution to the discharge, e.g., address discharge, a discharge initiation voltage can be reduced.

The second dielectric layer portion 48*b* may correspond to a portion making a smaller contribution to the discharge, e.g., address discharge, and/or may be formed thicker to result in a relatively smaller capacitance. By allowing a smaller voltage to be stored in the portion making the smaller contribution to the discharge, e.g., address discharge, efficiency of an energy recovery circuit can be improved.

As shown in FIG. 8, a width along the first direction, e.g., Y-direction, of the first portion 46*a* may be longer than a width along the first direction of the second portion 46*b*. Thus, a larger amount of the address electrode 46, i.e., the first portion 46*a*, may be covered with the thinner (t5) first portion of the first dielectric layer 48*a*, allowing for a greater capacitance between the first portion 36*a* and the respective electrode, e.g., scan electrode 32, of the discharge cell 18. It is possible to reduce the discharge initiation voltage and/or improve the efficiency of the energy recovery circuit by employing one or more aspects of the invention to selectively control capacitance within a discharge cell.

Figure 9:
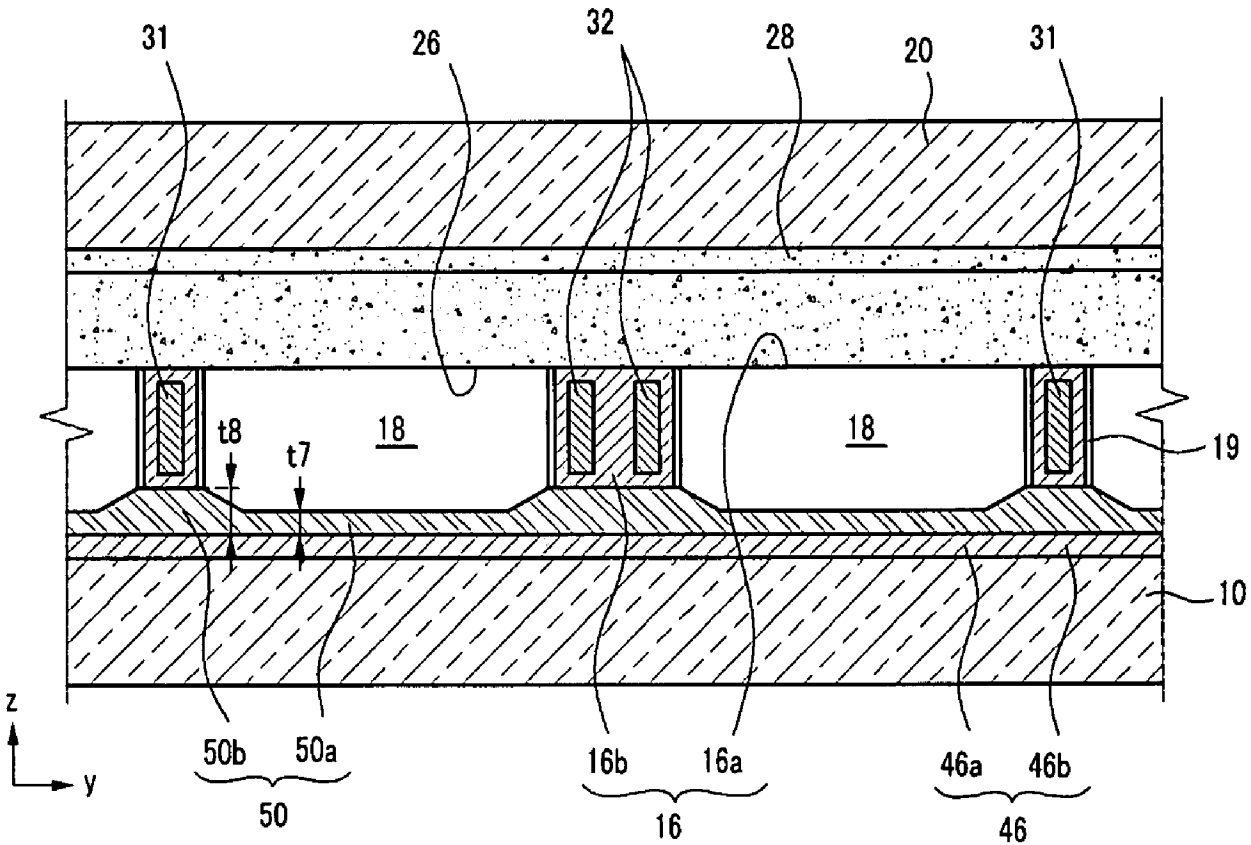
FIG. 9 illustrates a partial sectional view of a plasma display panel according to a fifth exemplary embodiment of the invention.

FIG. 9 illustrates a partial sectional view of a fifth exemplary embodiment of a plasma display panel employing one or more aspects of the invention. In this exemplary embodiment, similar to the fourth exemplary embodiment, a thickness of a first portion 46*a* of an address electrode 46 is substantially the same as that of a second portion 46*b* of the address electrode 46.

A first dielectric layer 50 may cover the address electrodes 46. A thickness (t7) of a first portion of the first dielectric layer 50*a* may be smaller than a thickness (t8) of a second portion of the first dielectric layer 50*b*. The thickness (t8) of the second dielectric layer portion 50*b* may gradually become smaller approaching the first dielectric layer portion 50*a* from a portion overlapping the protective layer 19. By enabling a greater charge to be stored between the first portion 50*a* of the address electrode 50 and the respective electrode, e.g., scan electrode 32, of the discharge cell and a smaller charge to be stored between the second portion 50*b* of the address electrode 50 and the electrode(s), e.g., scan electrode 32, a discharge initiation voltage can be reduced and efficiency of an energy recovery circuit can be improved.

Figure 10:
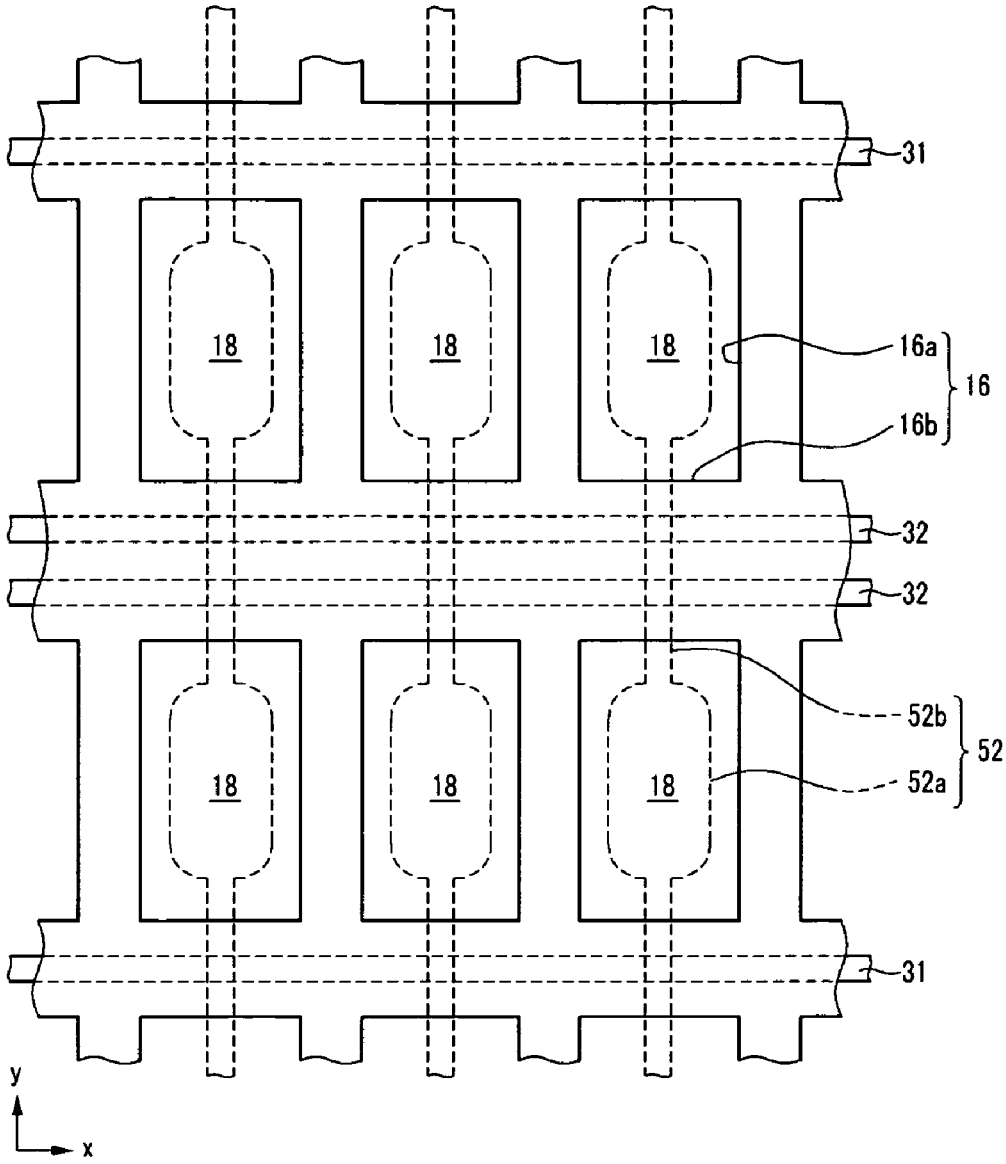
FIG. 10 illustrates a partial top plan view a sixth exemplary embodiment of the invention.

FIG. 10 illustrates a partial top plan view of a sixth exemplary embodiment of a plasma display panel employing one or more aspects of the invention. As shown in FIG. 10, an address electrode 52 may include a first portion 52*a* and a second portion 52*b*. The first portion 52*a* may have rounded or a curved border(s), and a second portion 52*b* may electrically connect the first portions 52*a* with one another. In embodiments of the invention, the address electrodes 52 may have different shapes, including rectangular-like, square-like, circular, triangular, polygonal, etc.

Figure 11:
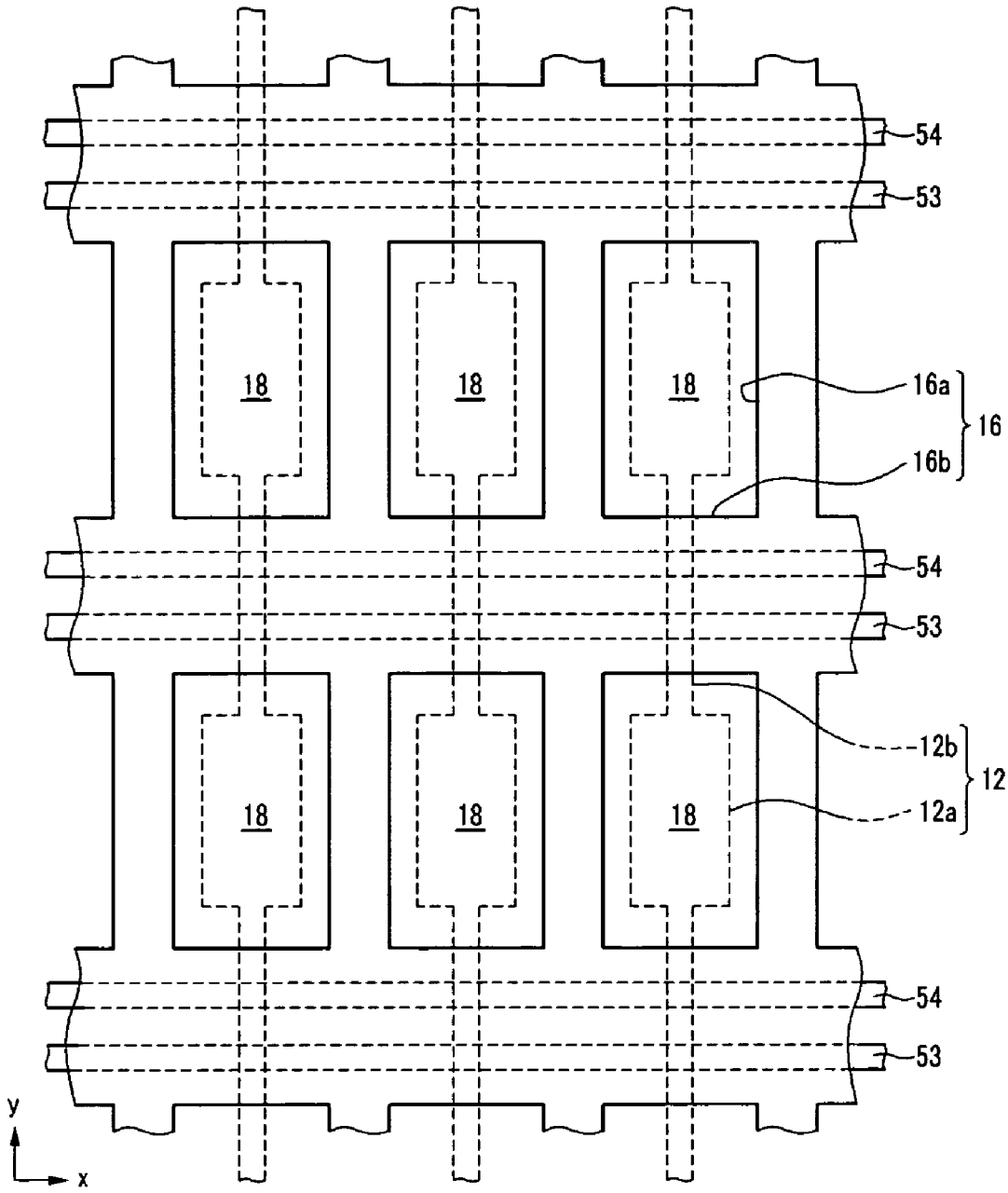
FIG. 11 illustrates a partial top plan view illustrating a seventh exemplary embodiment of the invention.

FIG. 11 illustrates a partial top plan view of a seventh exemplary embodiment of a plasma display panel employing one or more aspects of the invention. In embodiments of the invention, a sustain electrode 53 and a scan electrode 54 may be separately formed for each discharge cell 18. Between adjacent discharge cells neighboring along the first direction, an arrangement of sustain electrode/scan electrode and sustain electrode/scan electrode may be repeated.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims. It will be understood by those of ordinary skill in the art that one or more of the exemplary embodiments described above may be combined.

What is claimed is:

1. A plasma display panel, comprising:

a first substrate and a second substrate disposed facing each other and at least partially defining a plurality of discharge cells in a space therebetween;

a phosphor layer formed within each of the discharge cells;

an address electrode formed on a first side of the first substrate facing the second substrate and extending along a first direction;

a dielectric layer formed on the address electrode;

a first electrode extending along a second direction intersecting the first direction; and a second electrode extending along the second direction intersecting the first direction, the first electrode and the second electrode being electrically insulated from the address electrode, and at least a portion of each of the first electrode and the second electrode being associated with each of the discharge cells, at least one of the address electrode and the dielectric layer associated with each of the discharge cells including a first portion and a second portion, the first portion extending in a space between the first electrode and the second electrode associated with one of the discharge cells, the first portion extending only in a space defined between a first sidewall of the first electrode and a first sidewall of the second electrode, and the first sidewalls of the first and second electrodes facing each other, and at least a portion of the first portion having a first thickness along a third direction and the second portion having a second thickness along the third direction, at least one of the first thickness being different from the second thickness, wherein the third direction intersects the first direction and the second direction.

2. The plasma display panel as claimed in claim 1, wherein the second portion connects respective first portions of adjacent ones of the discharge cells.

3. The plasma display panel as claimed in claim 1, wherein the first electrode or the second electrode is shared by discharge cells neighboring each other along the first direction such that a respective surface of the first electrode or the second electrode is exposed to each of the neighboring discharge cells with which the first electrode or the second electrode is associated.

4. The plasma display panel as claimed in claim 1, wherein one of the first electrodes and one of the second electrodes are arranged between discharge cells neighboring each other along the first direction.

5. The plasma display panel as claimed in claim 1, wherein the plasma display panel includes a plurality of each of the first electrodes and the second electrodes arranged parallel to each other.

6. The plasma display panel as claimed in claim 1, wherein a step is formed at a boundary between the first portion and the second portion of one of the address electrode and the dielectric layer, the step being formed along at least one of a surface of the dielectric layer and a surface of the first electrode that faces the second electrode.

7. The plasma display panel as claimed in claim 6, wherein the step is formed at the boundary between the first portion and the second portion of the dielectric layer.

8. The plasma display panel as claimed in claim 7, wherein at the boundary between the first portion and the second portion of the dielectric layer, a thickness of the dielectric layer gradually changes from the first thickness to the second thickness, the first thickness being smaller than the second thickness.

9. The plasma display panel as claimed in claim 8, wherein the first thickness and the second thickness of the address electrode are equal.

10. The plasma display panel as claimed in claim 7, wherein the first thickness and the second thickness of the address electrode are equal.

11. The plasma display panel as claimed in claim 7, wherein the first thickness of the address electrode is greater than the second thickness of the address electrode.

12. The plasma display panel as claimed in claim 6, wherein a width of first portion the address electrode along the first direction is greater than a width of the second portion of the address electrode along the second direction.

13. The plasma display panel as claimed in claim 6, wherein the step is formed at the boundary between the first portion and the second portion of the address electrode and the first portion completely extends along the second direction between the first electrode and the second electrode associated with one of the discharge cells.

14. The plasma display panel as claimed in claim 1, wherein:

the first portion of the address electrode includes at least one protrusion extending only a portion of a distance along the second direction between the first electrode and the second electrode associated with one of the discharge cells, the at least one protrusion having the first thickness, and the first thickness of the address electrode is greater than the second thickness of the address electrode.

15. The plasma display panel as claimed in claim 1, wherein a width of the first portion of the address electrode along the first direction is greater than a width of the second portion of the address electrode along the first direction.

16. The plasma display panel as claimed in claim 1, further comprising a second dielectric layer covering the first electrode and the second electrode.

17. The plasma display panel as claimed in claim 16, wherein the second dielectric layer continuously surrounds neighboring ones of the first and second electrodes extending between neighboring ones of the discharge cells.

18. The plasma display panel as claimed in claim 16, wherein the second dielectric layer surrounds each of the first electrodes and the second electrodes extending between neighboring ones of the discharge cells such that a gap exists between each of the first and second electrodes.

19. The plasma display panel as claimed in claim 16, wherein one of the first electrodes and one of the second electrodes extends between each of the neighboring ones of the discharge cells.

* * * * *